US012152604B2

(12) United States Patent
Defoy et al.

(10) Patent No.: US 12,152,604 B2
(45) Date of Patent: Nov. 26, 2024

(54) BALANCING AND SEALING PISTON, AND ASSOCIATED COOLING CIRCUIT AND METHOD

(71) Applicant: Thermodyn SAS, Le Creusot (FR)

(72) Inventors: Benjamin Defoy, Le Creusot (FR); Thomas Alban, Le Creusot (FR)

(73) Assignee: Thermodyn SAS, Le Creusot (FR)

( * ) Notice: Subject to any disclaimer, the term of this patent is extended or adjusted under 35 U.S.C. 154(b) by 170 days.

(21) Appl. No.: 17/292,969

(22) PCT Filed: Nov. 20, 2019

(86) PCT No.: PCT/EP2019/025406
§ 371 (c)(1),
(2) Date: May 11, 2021

(87) PCT Pub. No.: WO2020/104061
PCT Pub. Date: May 28, 2020

(65) Prior Publication Data

US 2021/0404483 A1 Dec. 30, 2021

(30) Foreign Application Priority Data

Nov. 21, 2018 (FR) ..... 1871646

(51) Int. Cl.
*F04D 29/58* (2006.01)
*F04D 19/02* (2006.01)
(Continued)

(52) U.S. Cl.
CPC ..... *F04D 29/584* (2013.01); *F04D 19/02* (2013.01); *F04D 29/0516* (2013.01); *F04D 29/083* (2013.01)

(58) Field of Classification Search
None
See application file for complete search history.

(56) References Cited

U.S. PATENT DOCUMENTS

2003/0002977 A1* 1/2003 Camatti ..... F04D 29/083 415/119

FOREIGN PATENT DOCUMENTS

FR 2592688 A1 * 7/1987
JP H01237394 A 9/1989
(Continued)

OTHER PUBLICATIONS

Oyabu (JP 2008002412 A) + Machine Translation (Year: 2008).*
Laboube et al (WO 2004094833 A1) + Machine Translation (Year: 2004).*

*Primary Examiner* — Juan G Flores
(74) *Attorney, Agent, or Firm* — Paul Frank + Collins P.C.

(57) ABSTRACT

A balancing and sealing piston system for an integrated motor compressor is described. The system comprises a balancing piston designed to be mounted on a shaft of a motor compressor to compensate for the differential pressure applied to the impellers of the compression section of the motor compressor, and a sealing device surrounding the balancing piston and designed to be mounted on a case of the motor compressor to seal part of the compression section. The system further comprises a gas extraction port, the axial position of which is determined such that the pressure value of extracted gas is equal to a predetermined value that is less than the value of the discharge pressure.

5 Claims, 3 Drawing Sheets

(51) Int. Cl.
*F04D 29/051* (2006.01)
*F04D 29/08* (2006.01)

(56) References Cited

FOREIGN PATENT DOCUMENTS

| | | | |
|---|---|---|---|
| JP | H05263789 | A | 10/1993 |
| JP | H062693 | A | 1/1994 |
| JP | 2006 183465 | A | 7/2006 |
| WO | 2014/054440 | A1 | 4/2014 |

* cited by examiner

BALANCING AND SEALING PISTON, AND ASSOCIATED COOLING CIRCUIT AND METHOD

The present invention relates to an integrated motor compressor and more particularly a thrust balancing and sealing piston, a cooling circuit and a cooling method implementing such a piston.

Referring to FIG. 1, an integrated motor compressor comprises a common case 2 which is tight to the gas handled by the motor compressor, in which are placed an electric motor 3 and a compressor group 4, for example a multi-staged group comprising a set of impellers 5, 6, 7 and 8 carried by a shaft 9. The motor 3 drives in rotation a rotor 10 coupled to the shaft 9 of the compressor group 4. Bearings 11, 12, 13 and 14 are used to support the shaft line of the motor compressor and a thrust balancing and sealing piston 15 is mounted on the shaft 9.

The motor compressor 1 furthermore comprises a gas suction line 16, a discharge line 17, and an intake line 18 for cooling gas extracted from the outlet of the motor compressor.

The torque balancing and sealing piston 15 comprises a balancing piston 19 to compensate for the differential pressure applied to the impeller wheels 5, 6, 7 and 8 between the suction pressure and the discharge pressure, and a sealing device 20 surrounding the balancing piston 19 to render the end of the shaft tight by generating pressure losses.

A leakage flow passes through the piston 15 axially and is expelled from the case 2 by a leakage line 21 connected to the suction line 16.

The gas collected by the leakage line 21, having been compressed by the compressor 4, is at a higher temperature than the temperature of the gas in the suction line 16.

In general, the temperature of the gas admitted at the inlet of the motor compressor is on the order of 20 to 50° C. and the temperature of the leakage gas is on the order of 180° C.

The leakage gas thus increases the temperature of the gas circulating in the suction line 16, reducing the efficiency of the compressor 4.

The discharge line 17 is generally connected to a cooler 22 in order to cool the compressed gas.

A fraction of the gas leaving the cooler 22 is extracted and injected into the case 2 by the cooling gas admission line 18. Internally, this line 18 is connected to cooling means 23 of the case 2 in order to cool the electric motor 3 and the bearings 11, 12, 13 and 14.

In a variant, a fraction of gas leaving a wheel is extracted, cooled, and then injected into the case 2.

The compressed gas extracted at the outlet of the cooler 22 or at the outlet of a wheel recirculates in the motor compressor 1, decreasing the efficiency of the motor compressor and reducing the flow rate of gas leaving the cooler.

It is thus proposed to mitigate the drawbacks associated on the one hand with the recirculation of the leakage flow of the thrust balancing and sealing piston and on the other hand the cooling of the motor compressor.

Given the preceding, there is proposed, according to a first aspect, a balancing and sealing piston for an integrated motor compressor comprising:

- a balancing piston designed to be mounted on a shaft of the motor compressor to compensate for the differential pressure being applied to the wheels of a compression section of the motor compressor between the suction pressure and the discharge pressure; and

- a sealing device surrounding the balancing piston and designed to be mounted on the case of the motor compressor to render the compression section tight.

The balancing and sealing piston furthermore comprises a gas extraction port, the axial position of the extraction port being determined such that the pressure value of the extracted gas is equal to a predetermined value less than the value of the discharge pressure.

Advantageously, the sealing device comprises a toothed labyrinth comprising disks which are hollow at their center, distributed along an axial direction so as to create a pressure loss between two adjacent disks, the gas extraction port being situated between two adjacent disks.

Preferably, the sealing device comprises a seal with a honeycomb geometry, the gas extraction port being situated at the center of the seal.

According to another aspect, there is proposed a cooling circuit for an integrated motor compressor, comprising

- a balancing and sealing piston as defined previously;
- a gas cooler comprising an inlet connected to the gas extraction port and an outlet;
- cooling means for bearings and for an electric motor connected to the outlet of the gas cooler,
  - the pressure value of the extracted gas at the extraction port being at least equal to the value of the pressure losses generated by the gas cooler and the cooling means.

According to another characteristic, the cooling circuit moreover comprises a filter having an inlet connected to the outlet of the cooler and an outlet connected to the cooling means, the pressure value of the extracted gas at the extraction port being at least equal to the value of the pressure losses generated by the cooler, the cooling means and the filter.

Advantageously, the cooling circuit moreover comprises:

- a regulating valve connected to the outlet of the cooler and to the cooling means;
- at least one temperature sensor designed to measure the temperature of the electric motor or that of a bearing;
- a processing unit connected to the regulating valve and to the temperature sensor, and controlling the regulating valve,
  - the pressure value of the extracted gas at the extraction port being at least equal to the value of the pressure losses generated by the cooler, the valve, and the cooling means.

Preferably, the circuit according moreover comprises a filter having an inlet to the outlet of the cooler and an outlet connected to the regulating valve, the pressure value of the extracted gas at the extraction port being at least equal to the value of the pressure losses generated by the cooler, the regulating valve and the filter.

According to another characteristic, the cooling circuit moreover comprises a second regulating valve connected on the one hand to a discharge port of the motor compressor or to the outlet of a wheel and on the other hand to the cooling means, the second regulating valve being controlled by the processing unit.

According to a second aspect, there is proposed a method of cooling an integrated motor compressor wherein one regulates the flow rate of gas injected in the cooling means by the regulating valve such that the temperature detected by at least one temperature sensor is equal to a setpoint temperature.

Advantageously, when the temperature detected by the temperature sensor is greater than the setpoint temperature and the flow rate of gas injected by the regulating valve is equal to a predetermined maximum flow rate, one regulates the supplemental flow rate of gas injected in the cooling means by the second regulating valve such that the temperature detected by at least one temperature sensor is equal to the setpoint temperature.

Other characteristics and advantages of the invention will appear upon reading the following description of embodiments of the invention, given solely as nonlimiting examples and referring to the drawings, in which:

FIG. 1 already mentioned, illustrates a motor compressor of the prior art;

Figure 1:
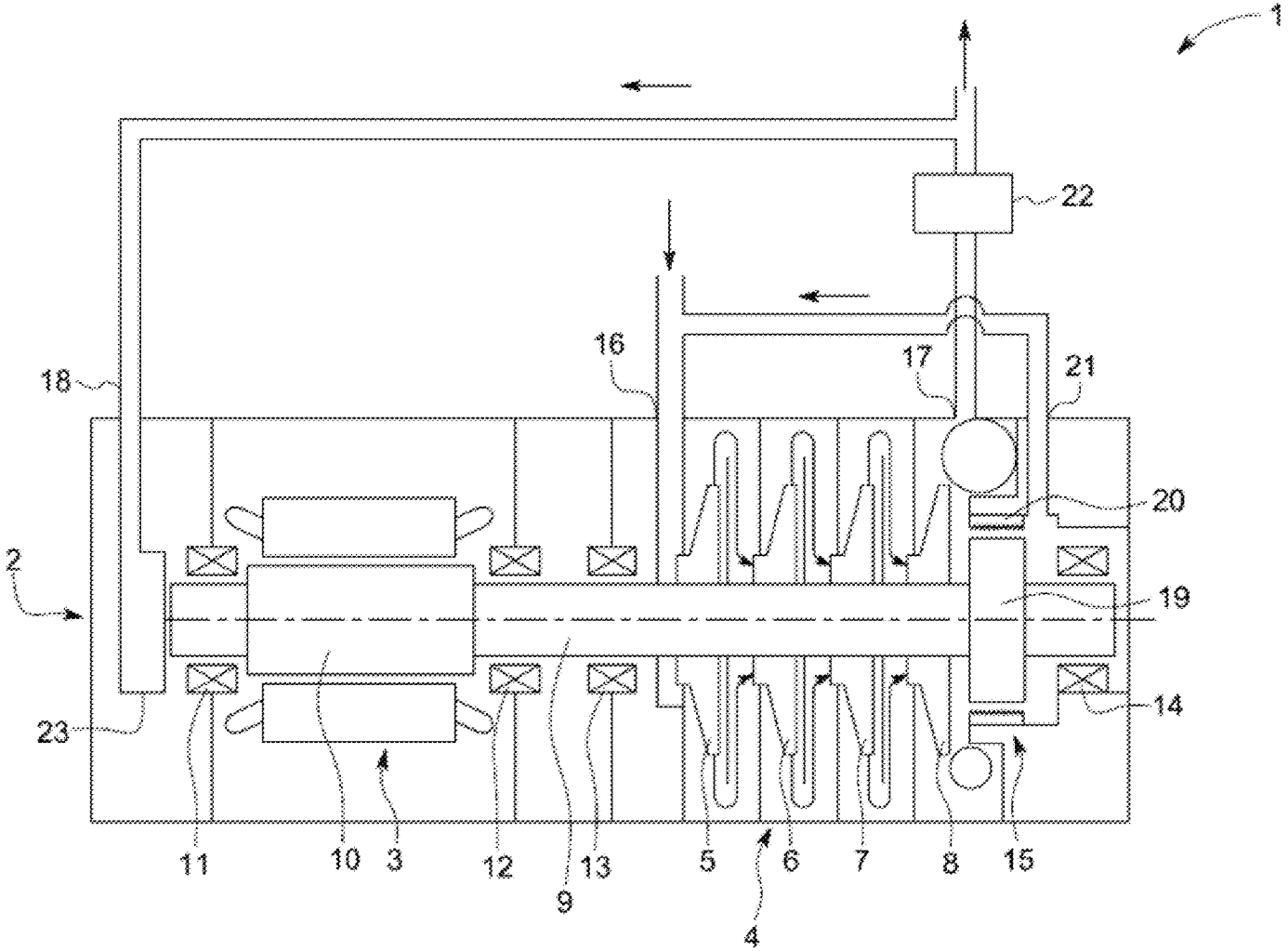
FIG. 1 Prior art
Figure 2:
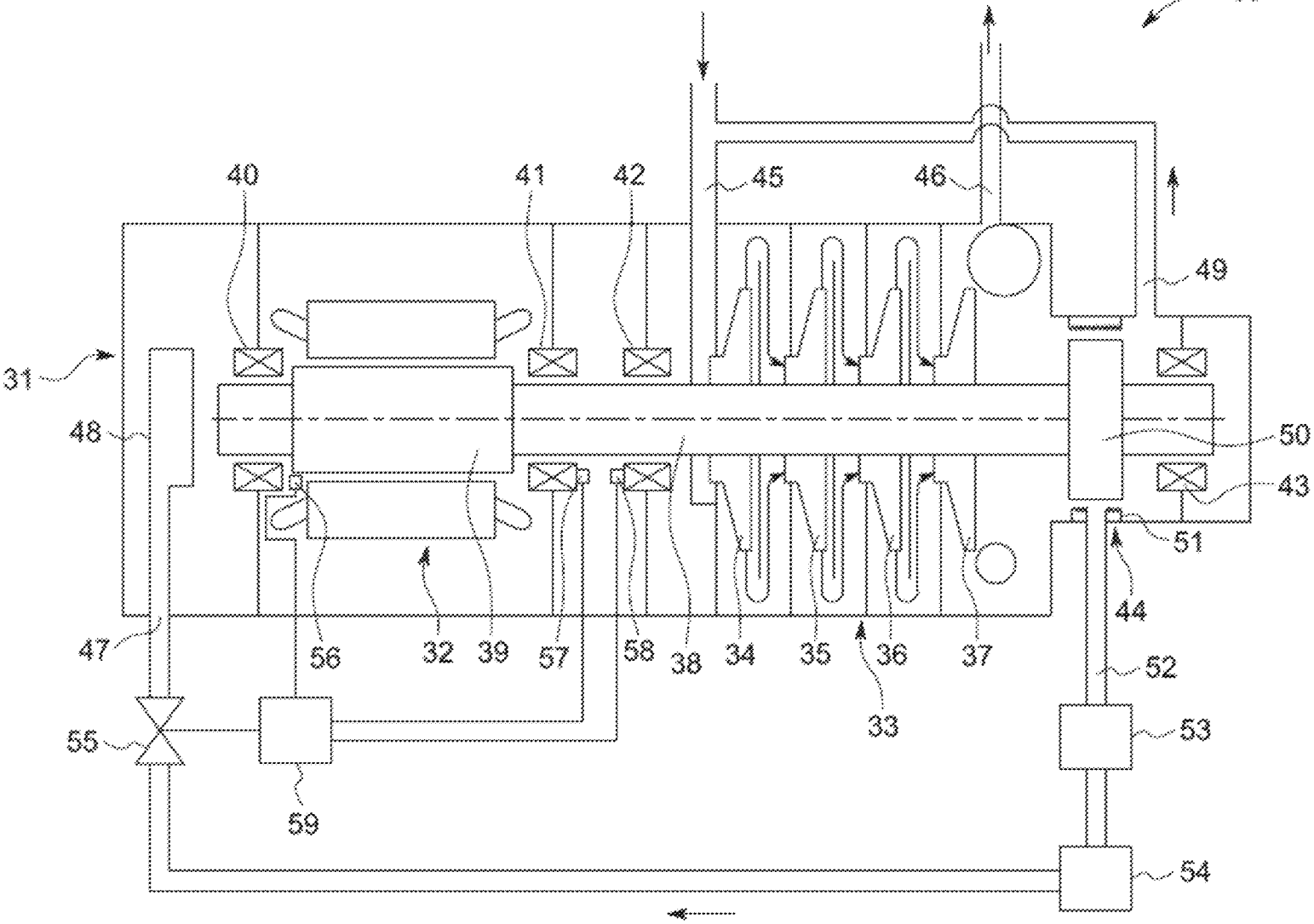
FIG. 2 illustrates a first embodiment of a motor compressor.

Refer to FIG. 2, which illustrates a first embodiment of an integrated motor compressor 30.

The integrated motor compressor 30 comprises a common tight case 31 in which are placed an electric motor 32 and a compressor group 33 comprising for example a compression section having a set of impeller wheels 34, 35, 36 and 37, carried by a shaft 38. The motor 32 drives the rotation of a rotor 39 coupled to the shaft 38 of the compressor group 33. Bearings 40, 41, 42 and 43 are used to support the shaft line of the motor compressor, and a balancing and sealing piston 44 mounted at one end of the shaft 38.

This piston 44 is designed to balance the thrusts acting on the compression stages of the motor compressor under the effect of the differential pressure and to ensure the tightness of the compression section.

The motor compressor 30 further comprises a gas suction port 45 and a compressed gas discharge port 46, a cooling port 47 connected to cooling means 48 of the electric motor 32 and bearings 40, 41, 42 and 43, and a leakage port 49 connected to the suction port 45.

The cooling means 48 deliver cooling gas.

A leakage flow passes axially through the thrust balancing and sealing piston 44 and is expelled from the case 31 by the leakage port 49.

The bearings 40, 41, 42 and 43 may comprise electromagnetic bearings so that the shaft 38 is supported when the motor compressor 30 is working.

The balancing and sealing piston 44 comprises a balancing piston 50 to compensate for the differential pressure being applied to the wheels of the compressor 33 between the suction pressure and the discharge pressure, and a sealing device 51 surrounding the balancing piston 50 to render the end of the shaft tight by generating pressure losses.

The piston 44 further comprises a gas extraction port 52.

The axial position of the extraction port 52 is determined such that the pressure value of the extracted gas is equal to a predetermined value Pext less than the value of the discharge pressure.

The sealing device 51 comprises a toothed labyrinth comprising disks which are hollow at their center, distributed along an axial direction so as to create a pressure loss between two adjacent disks, the gas extraction port 52 being situated between two adjacent disks.

In a variant, the sealing device 51 comprises a seal with a honeycomb geometry, the gas extraction port 52 being situated at the center of the seal.

The quantity of hot gas circulating through the leakage port 49 is diminished by the quantity of gas extracted by the extraction port 52.

Consequently, the temperature of the gas at the suction port is lower than that in the case of a thrust balancing and sealing piston not having an extraction port.

The efficiency of the motor compressor is improved.

The motor compressor 30 further comprises a cooling circuit comprising the balancing and sealing piston 44, a gas cooler 53 whose one inlet is connected to the extraction port 52 and an outlet is connected to an inlet of a filter 54, one outlet of the filter being connected to a regulating valve 55 connected to the cooling means 49.

The cooler 53 cools the gas circulating at its inlet.

The cooling circuit further comprises temperature sensors 56, 57, and 58 measuring the temperature of the electric motor 32 and that of the bearings 41 and 42, a processing unit 59 controlling the regulating valve 55 and receiving the temperature information transmitted by the temperature sensors.

In a variant, each bearing may be equipped with a temperature sensor.

The filter 54 filters the gas at the outlet to eliminate particles and water contained in the gas.

The processing unit 59 regulates the flow rate of gas injected into the cooling circuit of the motor compressor by the regulating valve 55 so that the temperature detected by the temperature sensors 56, 57, and 58 is equal to a setpoint temperature Tcons chosen so as not to degrade the electric motor 32 and the bearings.

The cooling circuit comprises a temperature control loop.

The processing unit 59 is realized for example by a microprocessor.

It may be any device able to control the regulating valve 55 such that the temperature detected by the temperature sensors 56, 57, and 58 is equal to the setpoint temperature Tcons.

The predetermined value Pext1 of the gas pressure extracted at the extraction port 52 is at least equal to the value of the pressure losses generated by the cooling means 48, the cooler 53, the filter 54 and the regulating valve 55. It is assumed that the pressure losses generated by the lines connecting the elements of the cooling circuit are negligible as compared to the pressure losses generated by said elements.

In a variant, the cooling circuit does not have a filter 54. The predetermined value Pext2 of the gas pressure extracted at the extraction port 52 is at least equal to the value of the pressure losses generated by the cooling means 48, the cooler 53 and the regulating valve 55.

According to other embodiments, the cooling circuit does not have a valve 55. The predetermined value Pext3 of the gas pressure extracted at the extraction port 52 is equal to the predetermined value Pext1 minus the value of the pressure losses generated by the valve 55 if the circuit includes the filter 54 or to the predetermined value Pext2 minus the value of the pressure losses generated by the valve 55.

The cooling means 48 inject the leakage gas escaping from the piston referenced as 44.

Consequently, the cooling gas is not extracted at the discharge port 46 or at one of the wheels 34, 35, 36 and 37, reducing the recirculation of the gas. The efficiency of the motor compressor is improved.

Figure 3:
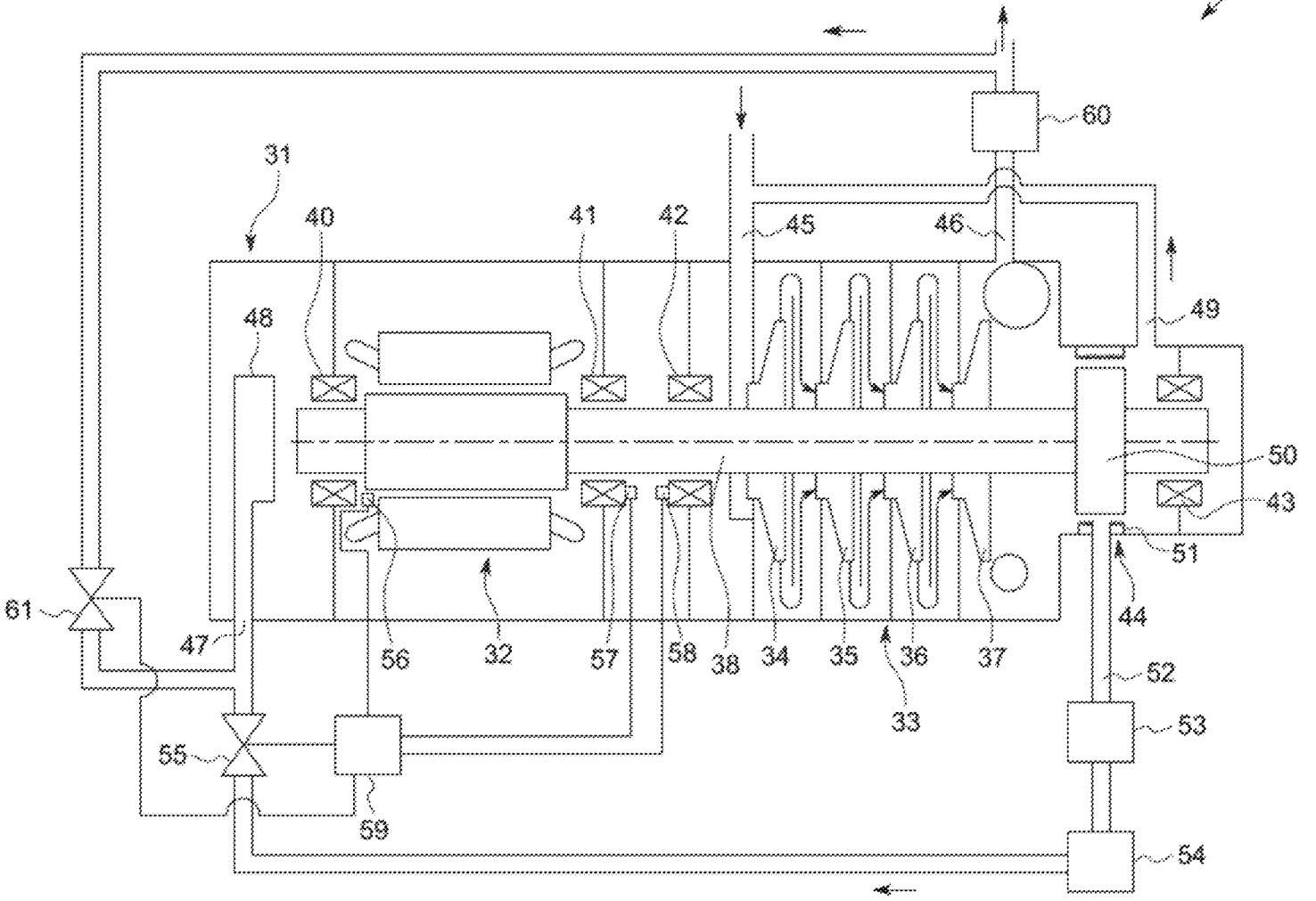
FIG. 3 illustrates a second embodiment of the motor compressor.

Refer now to FIG. 3, which illustrates a second embodiment of an integrated motor compressor 30.

In the following, the elements identical to those previously described are identified by the same numerical references.

This embodiment differs from the first embodiment in that the cooling circuit further comprises a second cooler 60, whose one inlet is connected to the discharge port 46, and a second regulating valve 61 connected to an outlet of the second cooler 60.

In a variant, the inlet of the second cooler 60 is connected to the outlet of a wheel 34, 35, 36 or 37 of the compression section.

The second cooler 60 cools the gas leaving the compressor 33.

According to other embodiments, the second regulating valve 61 is connected directly to the discharge port 46 or to the outlet of a wheel 34, 35, 36 or 37 of the compression section.

The second regulating valve 61 is further connected to the cooling port 47.

The processing unit 59 further controls the second regulating valve 61 so that when the temperature detected by the temperature sensors 56, 57 and 58 is greater than the setpoint temperature Tcons and the flow rate of gas injected by the first regulating valve 55 is equal to a predetermined maximum flow rate, the flow rate of supplemental gas injected by the second regulating valve in the cooling means 48 diminishes the temperature detected by the temperature sensors until it is equal to the setpoint temperature Tcons.

The predetermined maximum flow rate is the maximum flow rate of gas passing through the first regulating valve 55.

In a variant, if the cooling circuit does not contain the first regulating valve 55, the processing unit 59 controls the second regulating valve 61 so that when the temperature detected by the temperature sensors 56, 57 and 58 is greater than the setpoint temperature Tcons, the supplemental flow rate of gas injected by the second regulating valve in the cooling means 48 diminishes the temperature detected by the temperature sensors until it is equal to the setpoint temperature Tcons.

In this embodiment, if the leakage gas flow rate extracted at the extraction port 52 is not sufficient to cool the motor 32 and the bearings to the setpoint temperature Tcons, a supplemental gas flow is extracted at the discharge port 46.

The cooling capacity of the cooling circuit is improved.

Since the supplemental gas flow extracted at the discharge port is negligible as compared to the gas flow leaving the compressor 34, the efficiency of the motor compressor is not degraded.

According to other embodiments, the motor compressor 30 may comprise several compression sections mounted on its shaft, each compression section being connected to a thrust balancing and sealing piston.

The thrust balancing and sealing piston whose low pressure value is the lowest comprises the gas extraction port.

The invention claimed is:

1. A balancing and sealing piston system for an integrated motor compressor comprising:

a balancing piston mounted on a shaft of the integrated motor compressor, the integrated motor compressor having a case, a compression section comprising impellers mounted to the shaft, a motor to drive the shaft and bearings to support the shaft, wherein the compression section has a suction side that generates a suction pressure and a discharge side that generates a discharge pressure, wherein during operation, a differential pressure relative to the suction pressure and discharge pressure acts on the impellers and the balancing piston compensates for the differential pressure to balance the impellers;

a seal surrounding the balancing piston and mounted to the case of the integrated motor compressor;

a gas extraction port located at an axial position relative to the shaft, wherein the axial position of the extraction port is set so that the pressure of gas extracted through the gas extraction port is equal to a predetermined pressure value that is less than the discharge pressure; and a gas cooler having an inlet connected to the gas extraction port and an outlet connected to a filter, the filter having an outlet connected to a regulating valve, wherein the pressure value of the gas extracted at the extraction port is at least equal to a value representative of the pressure losses generated by the gas cooler, the regulating valve and the filter.

2. The balancing and sealing piston system according to claim 1, wherein the seal comprises a toothed labyrinth comprising disks, each of the disks having a hollow center, wherein the disks are distributed along an axial direction relative to the shaft to create a pressure loss between two adjacent disks, and wherein the axial position of the gas extraction port is located between two adjacent disks.

3. The balancing and sealing piston system according to claim 1, wherein the gas extraction port is situated at the center of the seal.

4. A balancing and sealing piston system for an integrated motor compressor comprising:

a balancing piston mounted on a shaft of the integrated motor compressor, the integrated motor compressor having a case, a compression section comprising impellers mounted to the shaft, a motor to drive the shaft and bearings to support the shaft, wherein the compression section has a suction side that generates a suction pressure and a discharge side that generates a discharge pressure, wherein during operation, a differential pressure relative to the suction pressure and discharge pressure acts on the impellers and the balancing piston compensates for the differential pressure to balance the impellers;

a seal surrounding the balancing piston and mounted to the case of the integrated motor compressor; and a gas extraction port located at an axial position relative to the shaft, wherein the axial position of the extraction port is set so that the pressure of gas extracted through the gas extraction port is equal to a predetermined pressure value that is less than the discharge pressure, wherein the motor and the bearings are cooled by a cooling gas comprised of a flow of leakage gas that escapes from the balancing piston and is channeled from the extraction port through a cooling port to the motor and the bearings.

5. The balancing and sealing piston system according to claim 4, wherein if the flow of leakage gas is not sufficient to cool the motor and the bearings, the cooling gas further comprises a flow of supplemental gas that is channeled from a discharge port in the compression section through the cooling port to the motor and the bearings.

* * * * *